US006966795B2

(12) United States Patent
Xu

(10) Patent No.: US 6,966,795 B2
(45) Date of Patent: Nov. 22, 2005

(54) SURFACE MOUNTED ELECTRICAL COMPONENT

(75) Inventor: Pei Ren Xu, Dollard des Ormeaux (CA)

(73) Assignee: Weco Electrical Connectors, Inc., Montreal (CA)

( * ) Notice: Subject to any disclaimer, the term of this patent is extended or adjusted under 35 U.S.C. 154(b) by 0 days.

(21) Appl. No.: 10/437,022

(22) Filed: May 14, 2003

(65) Prior Publication Data

US 2004/0229503 A1 Nov. 18, 2004

(51) Int. Cl.[7] ..... H01R 13/73
(52) U.S. Cl. ..... 439/571; 439/567; 439/564
(58) Field of Search ..... 439/571, 83, 570, 439/17 C, 573, 564, 559, 567, 909

(56) References Cited

U.S. PATENT DOCUMENTS

| | | | | | |
|---|---|---|---|---|---|
| 4,173,387 | A | * | 11/1979 | Zell | 439/557 |
| 4,659,156 | A | * | 4/1987 | Johnescu et al. | 439/63 |
| 5,066,237 | A | * | 11/1991 | Shiley | 439/82 |
| 5,407,364 | A | * | 4/1995 | Tzeng et al. | 439/567 |
| 5,435,750 | A | * | 7/1995 | Kosmala | 439/567 |
| 5,601,453 | A | * | 2/1997 | Horchler | 439/567 |
| 6,095,857 | A | * | 8/2000 | Isac | 439/571 |
| 6,102,735 | A | * | 8/2000 | Chen et al. | 439/573 |
| 6,307,753 | B1 | * | 10/2001 | Baginy et al. | 361/796 |

* cited by examiner

*Primary Examiner*—P. Austin Bradley
*Assistant Examiner*—Phuongchi Nguyen

(57) ABSTRACT

An electrical component having an insulating housing with the housing having a bottom mounting surface and at least one anchor element receiving aperture extending up into the housing from the bottom surface of the housing. An anchor element, having a bottom end, is shaped and sized to be inserted into the aperture from the bottom of the housing, the element frictionally held by the housing in the aperture with the element projecting slightly from the aperture to have its bottom end spaced slightly from the bottom surface of the housing.

A method of assembling the electrical component having a housing with a bottom surface and an aperture for receiving an anchor element extending up into the housing from the bottom surface. The anchor element has at least a portion that is sized and shaped to frictionally engage the housing while in the aperture. The method comprises the step of inserting the anchor element into the aperture in the housing from the bottom surface of the housing and pressing the element into the aperture to frictionally engage the housing, the element pressed into the aperture until it projects only slightly from the housing below the bottom surface of the housing.

An anchor element for use in the above electrical component having a cylindrical shape with the upper portion of the element stepped down slightly in diameter from the bottom portion, the upper portion sized to snugly enter an aperture in a housing of an electrical connector, the bottom portion sized to frictionally engage the wall of the housing defining the aperture.

19 Claims, 2 Drawing Sheets

SURFACE MOUNTED ELECTRICAL COMPONENT

BACKGROUND OF THE INVENTION

1. Field of the Invention

This invention is directed toward a surface mounted electrical component. The invention is also directed toward a method of assembling the electrical component. The invention is more particularly directed toward an electrical connector, adapted to be mounted on the top surface of a printed circuit board (PCB), and to a method of assembling the connector. The invention is further directed toward an anchor element forming part of the assembled electrical connector, the anchor element used in connecting the connector to a PCB.

2. Description of the Related Art

It is well known to mount an electrical component, such as an electrical connector, on the surface of a printed circuit board (PCB). The electrical connector is mounted on the surface of the PCB by soldering electrical connecting leads, located on the bottom of the connector, to the surface of the board, the connecting leads providing an electrical connection between contacts carried by the electrical connector and electrical elements carried by the PCB. However, the surface mount (SM) soldered joints between the connecting leads and the PCB are not very strong and can be easily broken by many types of force applied to the connector. To strengthen the connection between the electrical connector and the PCB, additional mechanical fastening means can be employed to connect the connector to the PCB. However, these fastening means have their own disadvantages. Excessive force may be required in the automated assembly machines, used in connecting the connectors to the PCB's, to insert mechanical fasteners. The excessive force may however cause damage to the connectors. Drilling of the PCB's may also be required to accommodate the additional mechanical fasteners which operation can increase the cost of assembly.

It is known to provide separate soldered connections between the connector and the PCB over and above the soldered lead connections. These separate soldered connections employ anchor elements mounted in the connector and extending down through the connector from the top surface of the connector to the bottom surface to abut soldering pads on the top surface of the PCB. An example of this type of connection is shown in U.S. Pat. No. 6,095,857. The arrangement lends itself to use in the automated assembly machines. However, the anchor elements employed do not always make good contact with the soldering pads on the PCB since the bottoms of all the anchor elements are not always aligned, and therefore the joints formed are not consistently strong. The length of the anchor element is critical and if too short, a poor solder joint is obtained between the end of the anchor and the pad. If the anchor element is too long, its bottom end can be deformed, by top pressure on the anchor element, into a cup-shaped configuration, again resulting in a poor solder joint. A too-long anchor element can also tilt the connector away from the PCB at one end resulting in poor seals between the connecting leads and the PCB.

SUMMARY OF THE INVENTION

It is the purpose of the present invention to provide electrical components which can be more securely anchored to PCB's. More particularly, it is the purpose of the present invention to provide electrical components with anchor elements constructed and mounted so as to allow more secure connection between electrical components and PCB's, the anchor elements consistently providing good contact with anchor pads on PCB's to form strong soldered connections. It is another purpose of the present invention to provide a method of assembling the electrical component with the anchor elements. It is a further purpose of the present invention to provide a novel anchor element for use with the electrical component.

In accordance with the present invention, anchor elements are provided which are inserted into apertures in an insulating housing forming part of an electrical connector, the anchor elements inserted into the apertures from the bottom surface of the housing which bottom surface is adjacent the top surface of the PCB when the connector is assembled to the PCB. The anchor elements are shaped and sized to have at least a portion of their length frictionally engage the housing within the aperture in which they are inserted so as to securely retain the anchor elements within the housing. The anchor elements have a flat bottom end that is at right angles to the longitudinal axis of the anchor element. The anchor elements are pushed into the apertures until only a very short length of the element, carrying the flat end surface, projects from the aperture past the bottom surface of the housing. This method of construction and assembly ensures that each anchor element will make good contact with the PCB since it extends slightly below the bottom surface of the housing.

The insertion of the anchor elements into the apertures is easily accomplished with automated assembly machines. The electrical connection leads can be inserted into the connector housing by the assembly machine at the same time as the anchor elements are being inserted since both are inserted into the housing from its bottom surface. Inserting both at the same time ensures that the bottom ends of the projecting anchor elements, and the bottom of the leads, are in the same plane. This provides good even contact between the leads and the elements and their respective solder pads on the PCB during soldering resulting in strong joints.

The anchor elements preferably are cylindrical with at least a bottom portion thereof sized and/or shaped to frictionally engage the housing when in the aperture so that the anchor element remains in the proper position when the electrical connector is positioned on the PCB for soldering. Preferably, the upper portion of the anchor element is sized and shaped to allow the anchor element to be easily inserted into the aperture and to guide it squarely into the aperture when the bottom portion of the anchor element is being pressed into the aperture to frictionally engage the housing.

The invention is particularly directed toward an electrical component having an insulating housing with the housing having a bottom mounting surface and at least one anchor element receiving aperture extending up into the housing from the bottom surface of the housing. The aperture is at right angles to the bottom surface. An anchor element, having a bottom end, is shaped and sized to be inserted into the aperture and frictionally held by the housing in the aperture with the element projecting slightly from the aperture to have the bottom end of the element spaced slightly from the bottom surface of the housing.

The invention is also particularly directed toward a method of assembling an electrical component having a housing with a bottom surface and an aperture for receiving an anchor element extending up into the housing from the bottom surface, the anchor element having at least a portion that is sized and shaped to frictionally engage the housing while in the aperture, the method comprising the step of inserting the anchor element into the aperture in the housing from the bottom surface of the housing and pressing the element into the aperture to frictionally engage the housing, the element pressed into the aperture until it projects only slightly from the housing below the bottom surface of the housing.

The invention is further particularly directed toward an anchor element having a cylindrical shape with the upper portion of the element stepped down slightly in diameter from the bottom portion, the upper portion sized to snugly enter an aperture in a housing of an electrical connector, the bottom portion sized to frictionally engage the wall of the housing defining the aperture.

BRIEF DESCRIPTION OF THE DRAWINGS

FIG. 1 is an exploded view of the electrical component and the PCB it is mounted on;

DESCRIPTION OF THE PREFERRED EMBODIMENTS

Figure 1:
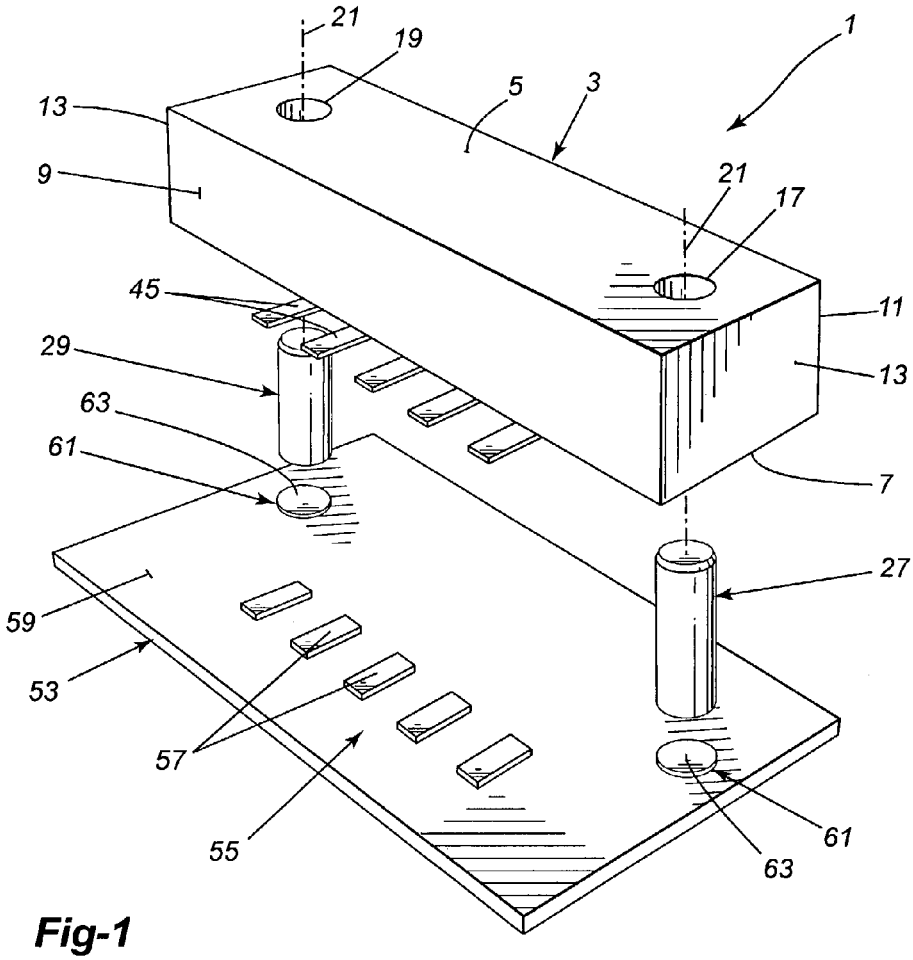

The electrical component of the present invention can be an electrical connector 1 as shown in FIG. 1. The electrical connector has a connector housing 3 made from insulating material, such as plastic, and has a generally parallelepiped shape with parallel top and bottom surfaces 5 and 7, parallel front and back surfaces 9 and 11 and parallel end surfaces 13.

The connector housing 3 has two apertures 17, 19, one adjacent each end 13 respectively of the housing. The apertures each receive a surface mount anchor element as will be described. The apertures 17, 19 are preferably cylindrical in shape and extend upwardly from the bottom surface 7 of the connector housing 3, the longitudinal axis 21 of the apertures at right angles to the bottom surface 7 of the housing. The apertures 17, 19 can extend through the housing 3 from the bottom surface 7 to the top surface 5, as shown. The apertures 17, 19 can however also be blind holes extending up from the bottom surface 7 of the housing 3 and terminating short of the top surface 5.

Figure 2:
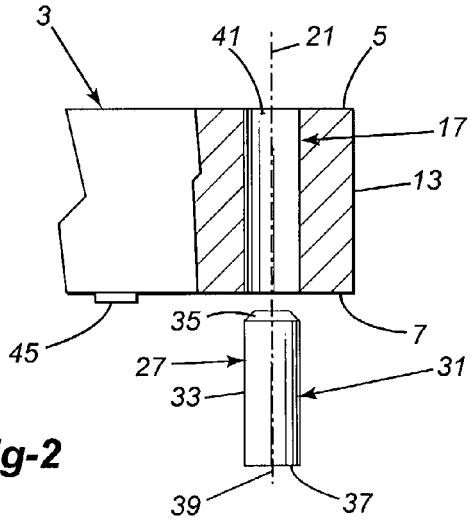
FIG. 2 is a cross-section view of a portion of the electrical component and an anchor element ready for mounting in the electrical component.

In accordance with the present invention, the connector housing 3 carries two anchor elements 27, 29, one mounted in each aperture 17, 19 respectively. Since the anchor elements 27, 29 are identical only one anchor element 27, and its associated aperture 17, will be described in detail. The anchor element 27, as shown in FIG. 2, is in the form of a cylinder 31 having a lower body portion 33 and an upper body portion 35 extending from the upper end of the lower body portion 33. The lower body portion 33 is quite long relative to the upper body portion 35. The upper portion 35 is a beveled portion, as shown in FIG. 2, beveled from the upper end of the lower body portion 33. The lower body portion 33 has a cross-sectional area slightly larger than the cross-sectional area of the aperture 17. To this end, the diameter of the lower body portion 33 is slightly greater than the diameter of the aperture. Since the upper portion 35 is beveled, it has an upper section that has a smaller diameter than the diameter of the aperture 17. The length of the cylinder 31 is normally slightly shorter than the length of the aperture 17. The bottom end 37 of the lower body portion 33 of the cylinder 31 is defined by a flat surface, the surface at right angles to the longitudinal axis 39 of the cylinder 31.

Figure 3:
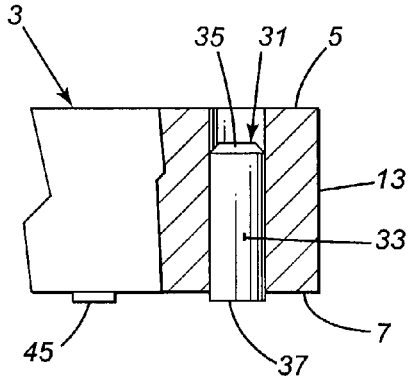
FIG. 3 is a cross-section view similar to FIG. 2 but with the anchor element mounted in the electrical component.

Each anchor element 27, 29 is mounted in its aperture 17, 19 respectively to have its flat, bottom end 37 spaced slightly from the bottom surface 7 of the connector housing 3 as shown in FIG. 3. The anchor element 27 is initially inserted into the aperture 17 with its beveled upper portion 35 easily leading the way into the aperture. The lower body portion 33 of the anchor 27 follows, the anchor element being pressed in and frictionally engaging the inner surface 41 of the aperture 17 and securely holding the anchor element 27 in the connector housing 3. The anchor element 27 is pushed nearly all the way into the aperture 17 with only a very short length remaining outside the aperture below the bottom surface 7. The flat bottom end 37 of the element 27 is parallel with the bottom surface 7 of the housing 3 but slightly spaced therefrom.

The connector housing 3 has one or more electrically conductive connecting leads 45 mounted thereon, the connecting leads 45 extending from the bottom surface 7 of the connector housing 3, and bent to extend laterally past the front surface 9 of the housing as is well known. Usually the leads 45 abut the bottom surface 7 of the housing 3 as shown in FIGS. 2 and 3. The bottom of each connecting lead 45 is in the same imaginary plane joining the flat, bottom ends 37 of the anchor elements 27, 29. Each connecting lead 45 is electrically connected by suitable means (not shown) to an electrical conductor (not shown) connected to the connector housing 3 above the bottom surface 7.

The connector housing 3 is adapted to be mounted on a printed circuit board (PCB) 53. The PCB 53 carries circuits and other electrical components, not shown, and has one set 55 of connecting lead solder pads 57 on its top surface 59 positioned to receive the connecting leads 45 on the connector housing 3 when the housing is mounted in the proper position on the PCB 53. The PCB 53 also has a second set 61 of anchor element solder pads 63 on its top surface 59 positioned to receive the anchor elements 27, 29 mounted on the housing 3 while the connecting leads 51 are mounted on the pads 57. The connector housing 3 is positioned on the PCB 53 with the connecting leads 45 on the pads 57 and the anchor elements 27, 29 on the pads 63 and is soldered to the PCB 53 via the solder pads 57, 63. The anchor element solder pads 63 securely hold the housing 3, via the anchor elements 27, 29 soldered to the pads 63, in place on the PCB 53 since the bottom ends 37 of the anchor elements are flat and parallel with the top surface 59 of the housing 3 and make good contact with the anchor pads 63. The soldering can take place by placing the tightly-held, assembled unit of the connector housing 3 and the PCB 53 into an oven, and heating the unit to the reflow temperatures of the solder to cause the solder in the solder pads to flow solder to the anchor elements to connect the anchor elements to the PCB and to flow solder to the connecting leads to connect them to the PCB as well. Since the bottom ends of the anchor elements and the bottom surfaces of the electrical connector leads are in the same plane and this plane is parallel to the top surface of the PCB when the electrical connector and PCB are assembled for soldering, all the soldered joints are uniform making for a strong connection between the connector and the PCB.

Figure 4:
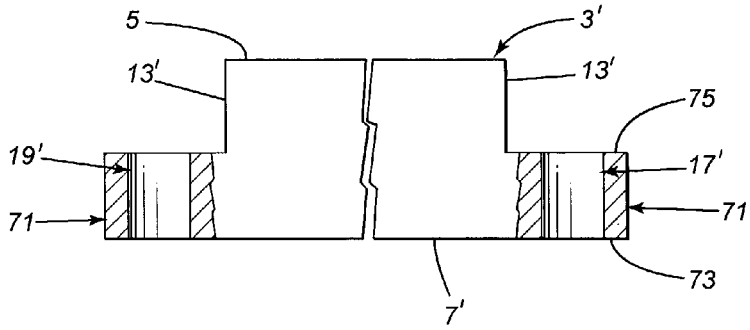
FIG. 4 is a cross-section view of another embodiment of the electrical component.

The apertures 17, 19 have been shown as extending through the height of the housing 3 between the top 5 and bottom 7 surfaces of the housing. The housing 3' can instead be shaped to have an ear 71 at each end 13' as shown in FIG. 4, Each ear 71 is shorter than the overall height of the rest of the housing 3 and has its bottom surface 73 as an extension of the bottom surface 7' of the rest of the housing 3. An aperture 17', 19' is formed in each ear 71 to receive an anchor element 27, 29 as before. The apertures can 17', 19' extend through the ears 71, as shown, or terminate short of the top surface 75 of the ears 71.

Figure 5:
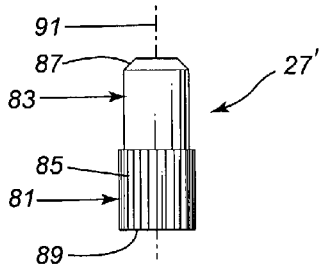
FIG. 5 is a front view of another embodiment of an anchor element.

The anchor element 27 has been described as being essentially cylindrical with a beveled top portion. The anchor element 27 could have other shapes as well. In a preferred embodiment, the anchor element 27' is generally cylindrical with a bottom cylindrical portion 81 and a slightly smaller top cylindrical portion 83 as shown in FIG. 5. The top portion 83 extends from the top end of the bottom portion 81, is concentric to it, and is about the same length as the bottom portion. The bottom portion 81 is knurled as shown at 85 to produce longitudinal ribs on the outer surface of the bottom portion 81. The bottom portion 81, with the ribs, is slightly larger in diameter than the diameter of the aperture. The diameter of the upper portion 83 is just slightly less than the diameter of the aperture. The upper end of the upper portion 83 can be beveled as shown at 87. The bottom end 89 of the bottom portion 81 is flat and at right angles to the longitudinal axis 91 of the anchor. The anchor element 27' is inserted into the aperture 17 from the bottom surface 7 of the connector housing 3 as before with the beveled portion 87 allowing easy initial insertion. The upper portion 83 easily follows into the aperture 17 and provides stability for the anchor element when the larger bottom portion 81 is pressed into the aperture 17 to frictionally engage the inner surface of the aperture. The ribs formed on the surface of the bottom portion 81 of the element 27' bite into the housing surface defining the aperture 17 thus anchoring the element securely in the housing.

Figure 6:
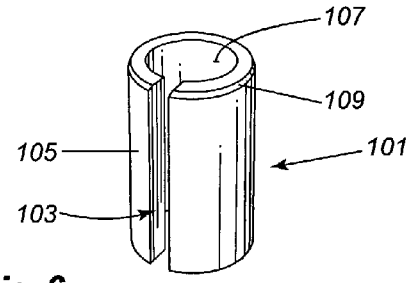
FIG. 6 is a perspective view or yet another embodiment of an anchor element.
Figure 7A:
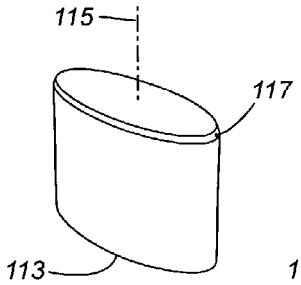
FIGS. 7*a* to 7*f* are examples of other anchor elements that can be used.
Figure 7B:
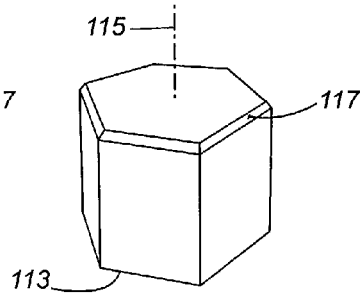
Figure 7C:
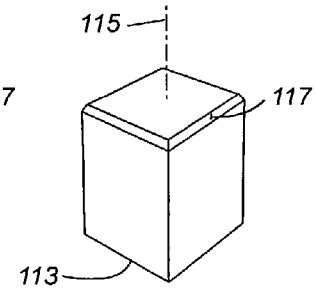
Figure 7D:
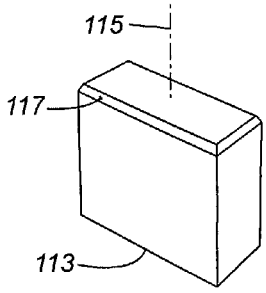
Figure 7E:
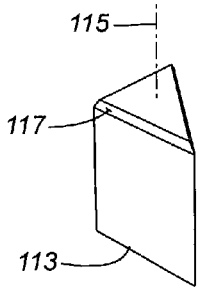
Figure 7F:
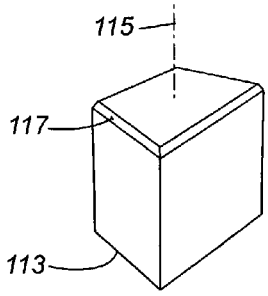

The anchor elements 27, 29 have been described as being cylindrical or generally cylindrical elements but they can have other shapes as well. In one embodiment, as shown in FIG. 6, the anchor element 101 can have a donut or ring shape with a radial slot 103 extending through the ring from its outer surface 105 to its inner surface 107. The upper end of the ring is beveled as shown at 109. The anchor element 101 squeezes together slightly at the slot 103 to allow entry of the element into an aperture.

Other shapes of anchor elements can be used such as oval or hexagonal as shown in FIGS. *7a*, *7b* or square, rectangular, triangle or even trapezoidal as shown in FIGS. *7b*, *7d*, *7e* and *7f* respectively. In each case the aperture would have a cross-sectional shape corresponding to the cross-sectional shape of the anchor element, but a cross-sectional area slightly smaller than the anchor pin's cross-sectional area so the anchor pin frictionally engages in the housing. Each anchor element has a flat bottom face 113 which face is transverse to the longitudinal axis 115 of the anchor pin so that the bottom face of the anchor element ends up parallel with the bottom surface of the housing. Each anchor element also preferably has beveled top edge 117 allowing easy initial entry of the anchor element into its aperture.

Preferably, the lower portion of the anchor elements are coated with tin to improve the soldered connection. While the anchor elements have been described as having the upper end beveled, those anchor elements that can be used with either end as the upper end, can have both ends beveled so that either end can be inserted into the aperture. The anchor elements, beveled at both ends, can also have both ends flat and at right angles to the longitudinal axis of the anchor element.

The invention also covers a method of assembling the connector 1 and more specifically assembling an anchor element in an aperture in a connector housing where the anchor element has an upper portion that is slightly smaller in cross-sectional area than the cross-sectional area of the aperture and a lower portion that is slightly larger in cross-sectional area than the cross-sectional area of the aperture. The method comprises: initially inserting the upper portion of an anchor element into an anchor element receiving aperture in a connector housing, the anchor element initially freely inserted into the aperture from the bottom surface of the housing, and then completing insertion of the anchor element into the aperture by pressing the lower portion of the anchor element into the aperture until the bottom end of the anchor element is slightly spaced from the bottom surface of the housing, the anchor element projecting slightly from the housing, the lower portion of the anchor element being frictionally held by the housing within the aperture. Preferably, the electrical connecting leads are pressed into the housing at the same time as the anchor elements are mounted in the apertures so that both the anchor elements and the electrical connecting leads have their bottoms in the same plane, this plane being parallel to the bottom surface of the housing. Normally, the electrical leads are pressed against the bottom surface of the housing as shown in FIG. 3, with the anchor elements projecting from the bottom surface a distance equal to the thickness of the electrical leads. With the bottom surfaces of the leads and the bottom ends of the anchor elements spaced from the bottom surface of the housing, good contact is obtained between the electrical leads and the lead solder pads and between the anchor elements and the anchor solder pads, without interference from the housing, leading to good, strong connections when soldering occurs.

In the description and following claims reference is made to the 'top' or 'upper' and 'bottom' or 'lower' portions or sections of the connector housing, the PCB, and the anchor elements. The 'top' or 'upper' and 'bottom' or 'lower' designations are made with reference the elements as shown in drawings for the sake of clarity, it being understood that the 'top' or 'upper' and 'bottom' or 'lower' parts of the various elements could arbitrarily be reversed when describing them.

I claim:

1. An electrical component having: an insulating housing with the housing having a bottom mounting surface and at least one anchor element receiving aperture extending up into the housing from the bottom surface of the housing, the aperture cylindrical over its entire length and at right angles to the bottom surface; a cylindrical anchor element having an upper cylindrical portion and a lower cylindrical portion slightly larger in diameter than the upper portion, the lower cylindrical portion cylindrical over its entire length, the upper portion sized to fit snugly within the aperture while the lower portion is sized to frictionally engage the wall of aperture when inserted into the aperture, the element inserted into the aperture from the bottom surface of the housing and frictionally retained in the aperture with part of the lower portion of the anchor element projecting slightly from the bottom surface to have the bottom end of the anchor element spaced a slight distance from the bottom surface of the housing, the bottom end being flat and parallel with the bottom surface of the housing.

2. An electrical component as claimed in claim 1 wherein the surface of the lower portion of the anchor element is knurled to form ribs on the surface of the lower portion.

3. An electrical component as claimed in claim 2 wherein the upper end of the upper portion of the anchor element is beveled to allow easy access of the element into the aperture.

4. An electrical component as claimed in claim 3 wherein the component includes electrical connector leads extending laterally from the housing, the leads parallel to the bottom surface of the housing, the bottom end of the anchor elements in the same plane as the bottom of the leads.

5. An electrical component as claimed in claim 4 wherein the leads abut the bottom surface of the housing.

6. A method of making an electrical component comprising: providing a housing with the housing having a bottom mounting surface and at least one anchor element receiving aperture having a uniform cross-sectional area throughout its entire length extending up into the housing from the bottom surface of the housing, the aperture at right angles to the bottom surface; and an anchor element having an upper portion sized to snugly enter the aperture and a bottom portion having a uniform cross-sectional area throughout its entire length which area is slightly larger than the cross-sectional area of the aperture; the method comprising the steps of: initially inserting the anchor element up into the aperture from the bottom mounting surface to have the upper portion of the element freely enter the aperture and then pushing the element into the aperture to have the bottom portion of the element frictionally engage the wall of the aperture, the element pushed in until it projects only slightly from the bottom surface to space the bottom end of the element a short distance from the bottom surface of the housing, the element retained in this position by frictional engagement with the wall of the aperture.

7. A method as claimed as claimed in claim 6 wherein the connector has electrical leads mountable in the housing, the electrical leads extending from the bottom of the housing and parallel with the bottom surface when mounted in the housing, the method including the step of inserting the leads up into the housing at the same time that the anchor elements are inserted into the apertures, the leads and the elements then pushed simultaneously into the housing and apertures respectively to have the bottom of the leads in the same plane as the bottom ends of the elements.

8. A method as claimed in claim 7 wherein the leads and the elements are pushed simultaneously into the housing and apertures respectively until the leads abut the bottom surface of the housing.

9. An electrical component having: an insulating housing with the housing having a bottom mounting surface and at least one anchor element receiving aperture extending up into the housing from the bottom surface of the housing, the aperture at right angles to the bottom surface and having a uniform cross-sectional area throughout its entire length; an anchor element, the anchor element having a bottom portion and an upper portion, the bottom portion having a uniform cross-sectional area throughout its entire length with a cross-sectional shape generally matching the cross-sectional shape of the aperture but slightly larger in cross-sectional area than the cross-sectional area of the aperture to an extant to allow the bottom portion to be inserted into the aperture and frictionally retained by the housing in the aperture, the bottom portion of the anchor element terminating in a bottom end, the anchor element inserted into the aperture with the upper portion leading the way and the bottom portion frictionally engaging the housing until the bottom end of the anchor element is spaced a slight distance outwardly from the bottom surface of the housing, the anchor element frictionally retained in place.

10. An electrical component as claimed in claim 9 wherein the housing has a top surface and the aperture extends from the bottom surface to the top surface.

11. An electrical component as claimed in claim 9 wherein the housing has a top surface and end surfaces joining the top and bottom surfaces, there being an anchor element aperture in the housing adjacent each end surface and an anchor element for each aperture.

12. An electrical component as claimed in claim 9 wherein the housing has a top surface and end surfaces joining the top and bottom surfaces; and a ear extending out from each end surface, the bottom surface of each ear an extension of the bottom surface of the housing, the top surface of each ear below the top surface of the housing; an aperture in each ear; and an anchor element for each aperture.

13. An electrical component as claimed in claim 9 wherein the component includes electrical leads at the bottom of the housing, the leads extending laterally from the housing and parallel to the bottom surface of the housing, the bottom end of the anchor element in the same plane as the bottom of the leads.

14. An electrical component as claimed in claim 13 wherein the leads abut the bottom surface of the housing.

15. An electrical component as claimed in claim 9 wherein the upper portion of the anchor element has a least a leading section having a smaller cross-sectional area than the cross-sectional area of the aperture, the leading section allowing initial easy entry of the anchor element into the aperture.

16. An electrical connector as claimed in claim 15 wherein the upper portion of the anchor element is a bevel at the top of the element.

17. An electrical component as claimed in claim 15 wherein the upper portion of the anchor element has a uniform cross-sectional area throughout its length with a cross-sectional shape generally matching the cross-sectional shape of the aperture but slightly smaller in cross-sectional area than the cross-sectional area of the aperture to provide a snug fit between the upper portion and the wall of the aperture.

18. An electrical component as claimed in claim 17 wherein the outer surface of the bottom portion of the anchor element is knurled.

19. An electrical component as claimed in claim 18 wherein the top of the upper portion of the anchor element is beveled.

* * * * *